US008016516B2

(12) United States Patent
Johnson et al.

(10) Patent No.: US 8,016,516 B2
(45) Date of Patent: Sep. 13, 2011

(54) VEHICLE-MOUNTED POTHOLE PATCHING APPARATUS

(75) Inventors: Eric Johnson, Salina, KS (US); Matthew R. Ogorzolka, Salina, KS (US)

(73) Assignee: Bergkamp Incorporated, Salina, KS (US)

( * ) Notice: Subject to any disclaimer, the term of this patent is extended or adjusted under 35 U.S.C. 154(b) by 384 days.

(21) Appl. No.: 12/337,466

(22) Filed: Dec. 17, 2008

(65) Prior Publication Data

US 2010/0150652 A1 Jun. 17, 2010

(51) Int. Cl.
*E01C 19/18* (2006.01)

(52) U.S. Cl. ..... 404/108

(58) Field of Classification Search ..... 404/101, 404/105, 106, 108, 109, 110; 366/186
See application file for complete search history.

(56) References Cited

U.S. PATENT DOCUMENTS

| | | | | | |
|---|---|---|---|---|---|
| 2,585,169 | A | | 2/1952 | Potter | |
| 2,640,286 | A | | 6/1953 | Briscoe | |
| 2,730,256 | A | * | 1/1956 | Louden et al. | 414/505 |
| 3,049,822 | A | | 8/1962 | McMullen | |
| 3,217,620 | A | | 11/1965 | Mindrum et al. | |
| 3,310,293 | A | * | 3/1967 | Zimmerman | 366/6 |
| 3,322,257 | A | * | 5/1967 | Phillips | 198/536 |
| 4,538,916 | A | * | 9/1985 | Zimmerman | 366/40 |
| 4,586,824 | A | * | 5/1986 | Haws | 366/34 |
| 4,768,884 | A | * | 9/1988 | Elkin | 366/28 |
| 4,781,513 | A | | 11/1988 | Sjogren et al. | |
| 4,830,533 | A | | 5/1989 | Miller | |
| 4,944,632 | A | | 7/1990 | Dillingham | |
| 5,131,788 | A | | 7/1992 | Hulicsko | |
| 5,433,520 | A | * | 7/1995 | Adams et al. | 366/8 |
| 5,542,478 | A | | 8/1996 | Heiple | |
| 5,988,935 | A | | 11/1999 | Dillingham | |
| 7,201,536 | B1 | | 4/2007 | Westbrook et al. | |
| 2004/0240939 | A1 | | 12/2004 | Hays et al. | |

OTHER PUBLICATIONS

Bergkamp, Inc., FP5 Flameless Pothole Patcher (copyright dated 2007).
H.D. Industries, Inc., Pro-Patch Pothole Patcher (received Dec. 17, 2007) (6 pgs).
H.D. Industries, Inc., Pro-Patch at http://www.pro-patch.com (copyrighted 2004) (18 pgs).
PB Loader Corporation, PB Loader at http://www.pblcorp.com (copyrighted 2008) (8 pgs).
Northwest Manufacturing & Distribution Inc., Manufacturer of the World Famous Thermo-Lay® Hot Asphalt and Sanding Machine at http://www.thermo-lay.com (copyrighted 1998) (7 pgs).

* cited by examiner

*Primary Examiner* — Gary S Hartmann
(74) *Attorney, Agent, or Firm* — Hovey Williams LLP

(57) ABSTRACT

A material dispensing vehicle broadly includes a material hopper supported by the vehicle and a swing auger with inlet and outlet ends. The swing auger is coupled to the vehicle for shifting into and out of an extended operating position where the inlet end is disposed to receive material from a discharge opening of the hopper and the outlet end can be outboard of the vehicle. From the operating position, the swing auger is shiftable into a compact storage position where the inlet end is spaced from the discharge opening and the outlet end is inboard of its outboard position.

20 Claims, 11 Drawing Sheets

VEHICLE-MOUNTED POTHOLE PATCHING APPARATUS

BACKGROUND

1. Field

The present invention relates generally to a vehicle with a material hopper. More specifically, embodiments of the present invention concern a vehicle-mounted hopper for holding pavement material and a swing auger for dispensing pavement material from the hopper.

2. Discussion of Prior Art

Asphalt-paved highways often develop pavement failures, such as cracks, potholes, or buckled sections, due to extended use and extreme ambient conditions. Consequently, asphalt highways require periodic maintenance by road crews to repair the failures and maintain a smooth road surface. An asphalt patching truck is used by a road crew to carry asphalt mix to the location of a pavement failure and selectively dispense the asphalt mix to repair the failure. Some prior art patching trucks include a material hopper supported on the truck and an auger for dispensing the material away from the truck.

Prior art asphalt patching trucks are problematic and suffer from various undesirable limitations. For instance, prior art patching trucks that include a hopper and auger are deficient because the auger is bulky and projects unsafely from the hopper, even when the auger is stored for transportation.

SUMMARY

Embodiments of the present invention provide an asphalt supply vehicle that does not suffer from the problems and limitations of the prior art patching trucks set forth above.

One embodiment of the present invention concerns a material dispensing vehicle that broadly includes a wheeled vehicle, a material hopper, and an elongated swing auger. The material hopper is supported by the vehicle and presents a discharge opening. The elongated swing auger presents inlet and outlet ends. The swing auger is operably coupled to the vehicle and shiftable into and out of an operating position where the inlet end is disposed to receive material from the discharge opening and the outlet end projects outward beyond at least one of the vehicle and hopper to dispense the augered material. The swing auger is laterally shiftable into and out of a storage position where the inlet end is spaced from the discharge opening.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 2:
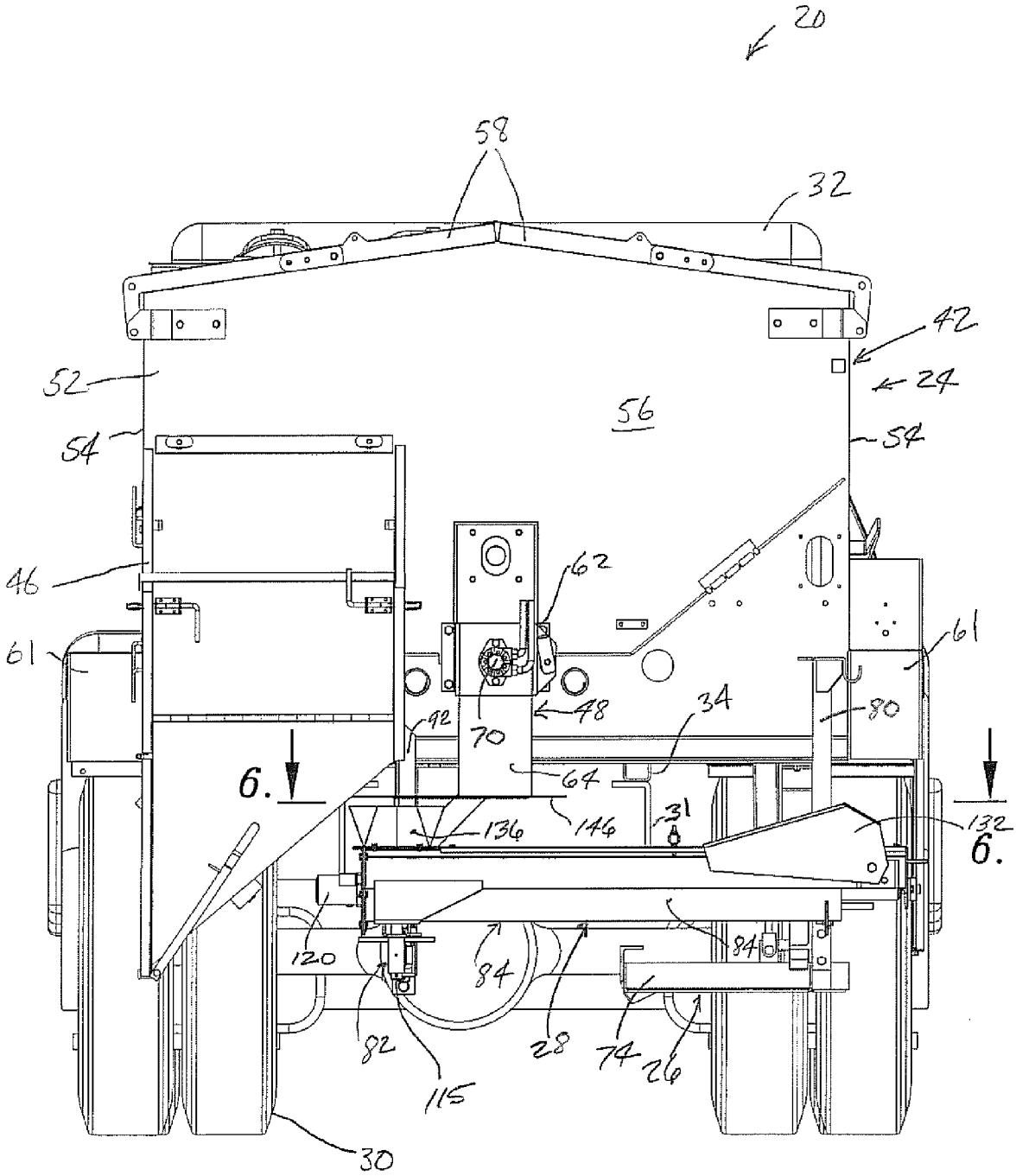
FIG. 2 is a rear elevation of the asphalt supply vehicle shown in FIG. 1, showing a truck, hopper assembly, and swing auger of the asphalt supply vehicle, with the swing auger in a storage position.
Figure 6:
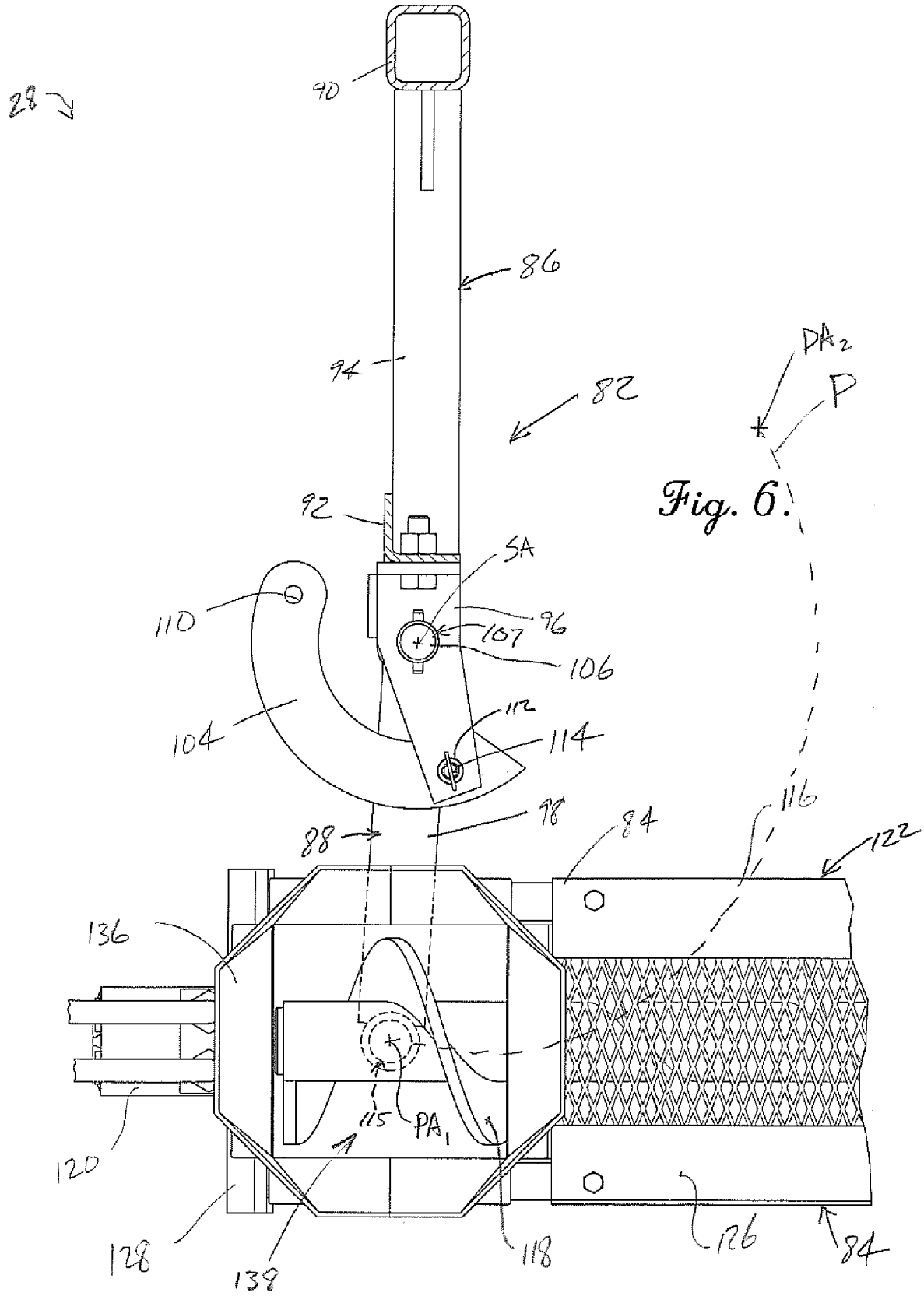
Figure 7:
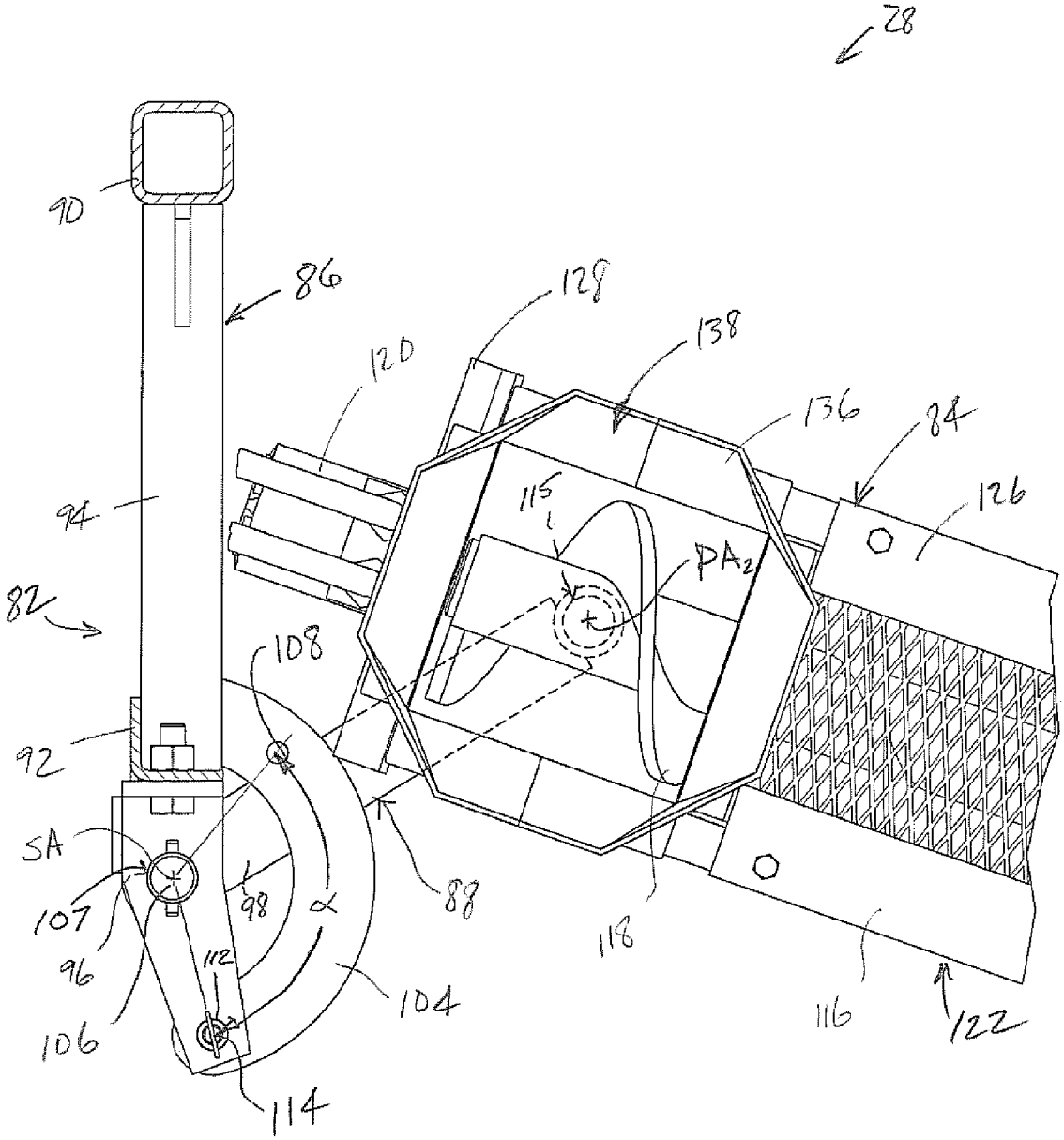
Figure 8:
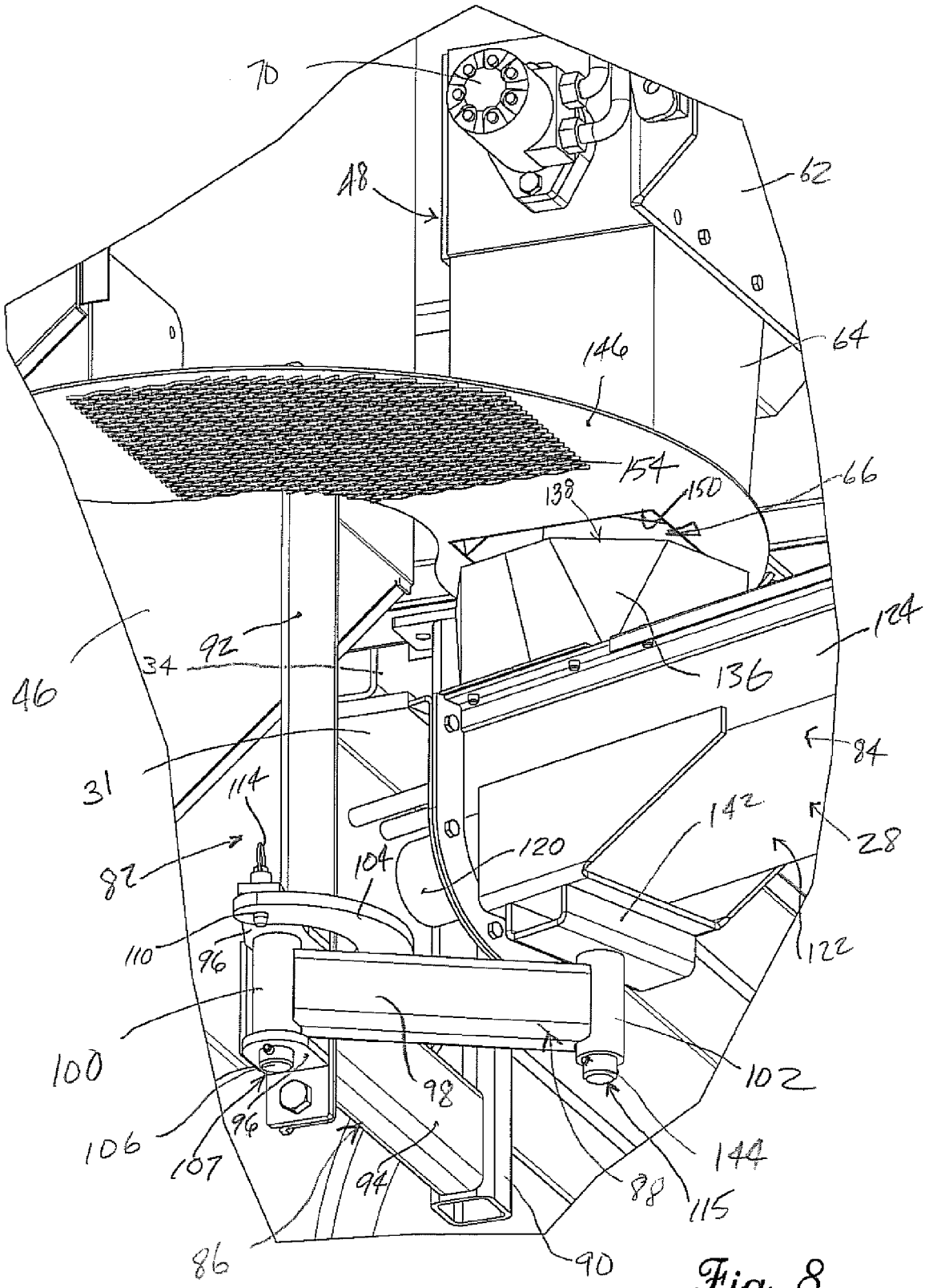
Figure 9:
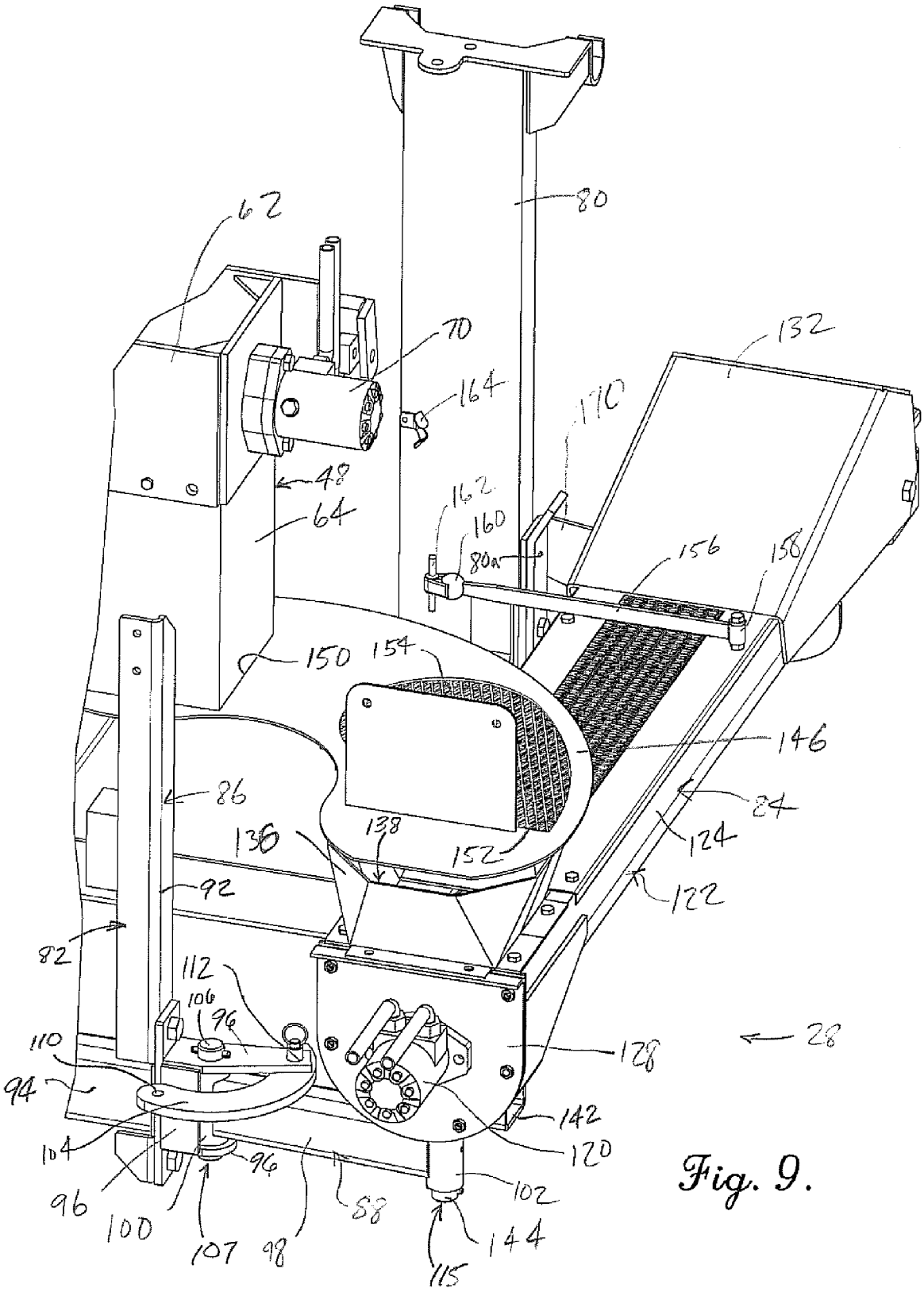
Figure 10:
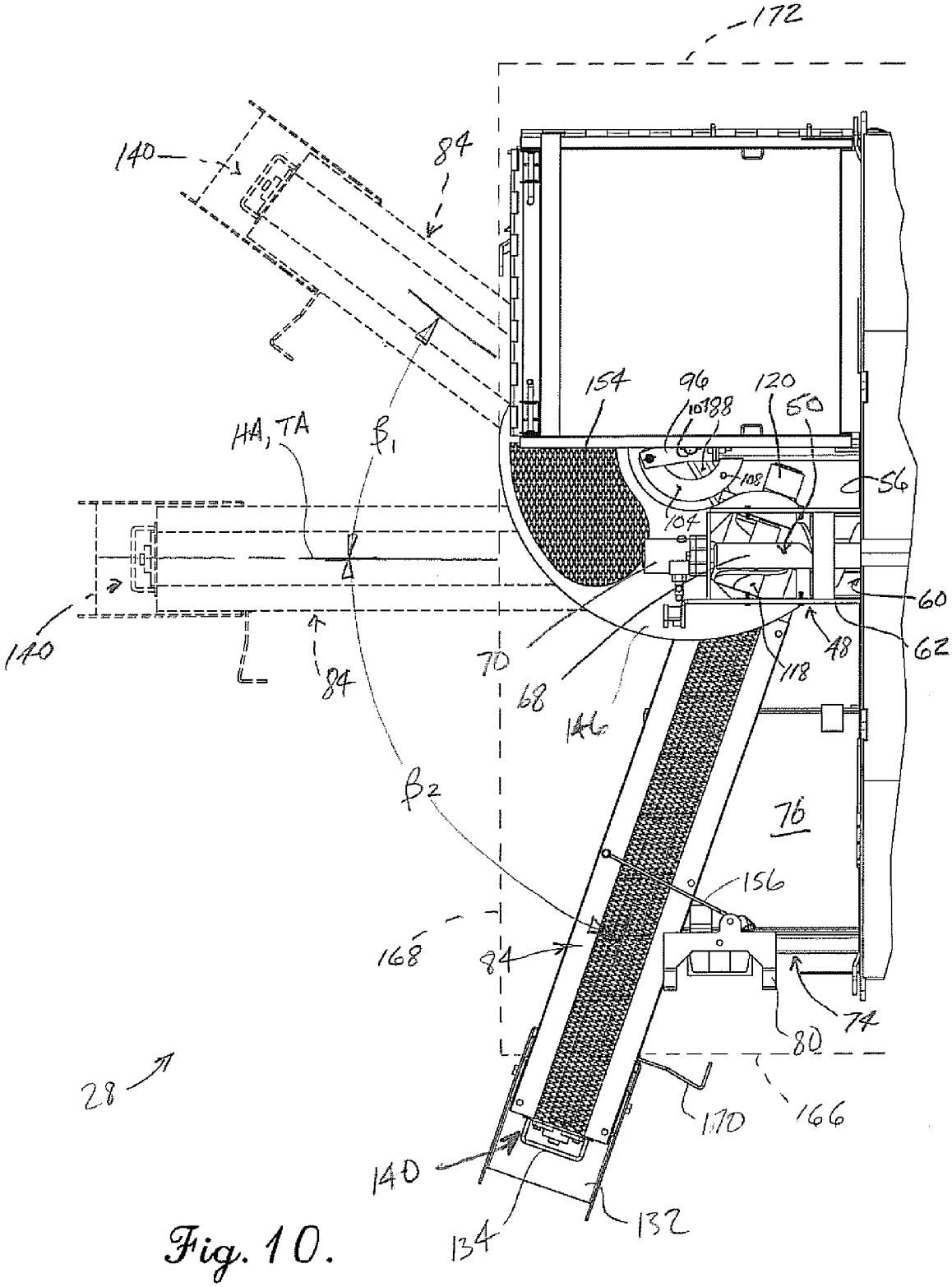
Figure 11:
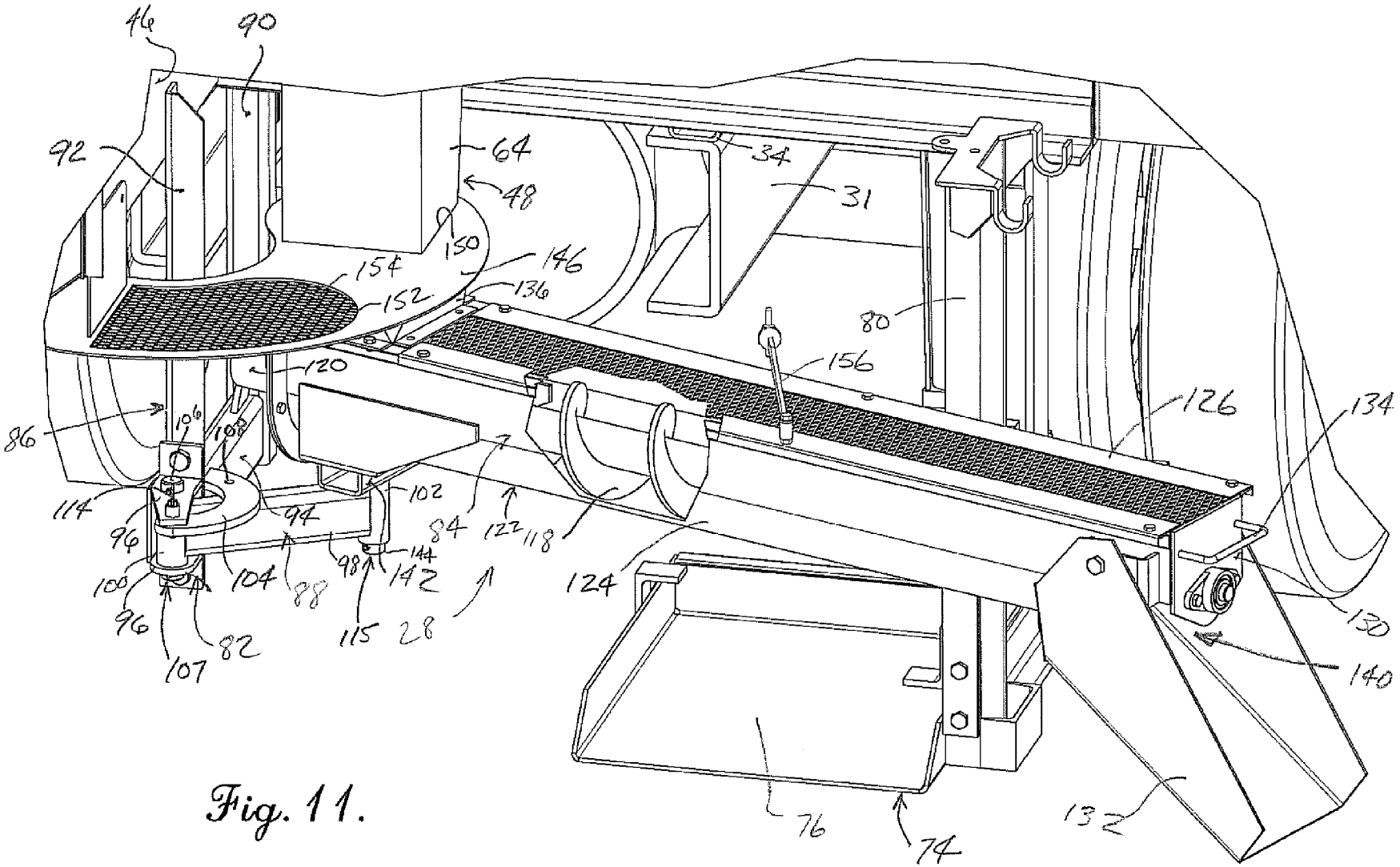

FIG. 6 is a fragmentary cross section of the asphalt supply vehicle taken along line 6-6 in FIG. 2, showing a linkage supporting the swing auger in the storage position, with the linkage including a mounting bracket and a pivot arm that shiftably interconnects the bracket and swing auger, and with the pivot arm in a rearwardly projecting storage location that corresponds to the auger storage position;

FIG. 7 is a fragmentary cross section of the asphalt supply vehicle similar to FIG. 6, showing the linkage supporting the swing auger in the operating position, with the pivot arm being rotated from the storage location into an operating location that corresponds to the auger operating position;

FIG. 8 is a fragmentary rear perspective of the asphalt supply vehicle shown in FIGS. 1-5, showing the swing auger in the operating position, with an inlet end of the auger being positioned below a spout of the hopper assembly;

FIG. 9 is a fragmentary rear perspective of the asphalt supply vehicle shown in FIGS. 1-5 and 8, showing the swing auger in the storage position and a latch of the auxiliary platform receiving a complemental lug of the swing auger to restrict pivotal movement of the swing auger;

FIG. 10 is a fragmentary plan view of the asphalt supply vehicle shown in FIGS. 1-5 and 8-9, showing the swing auger in the operating position and held in an outermost right side orientation by a retaining strap, with a rearmost orientation and an outermost left side orientation being shown in broken lines to depict the range of pivotal movement of the swing auger; and FIG. 11 is a fragmentary rear perspective of the asphalt supply vehicle shown in FIGS. 1-5 and 8-10, with a housing of the swing auger being broken away to show the auger screw.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 1:
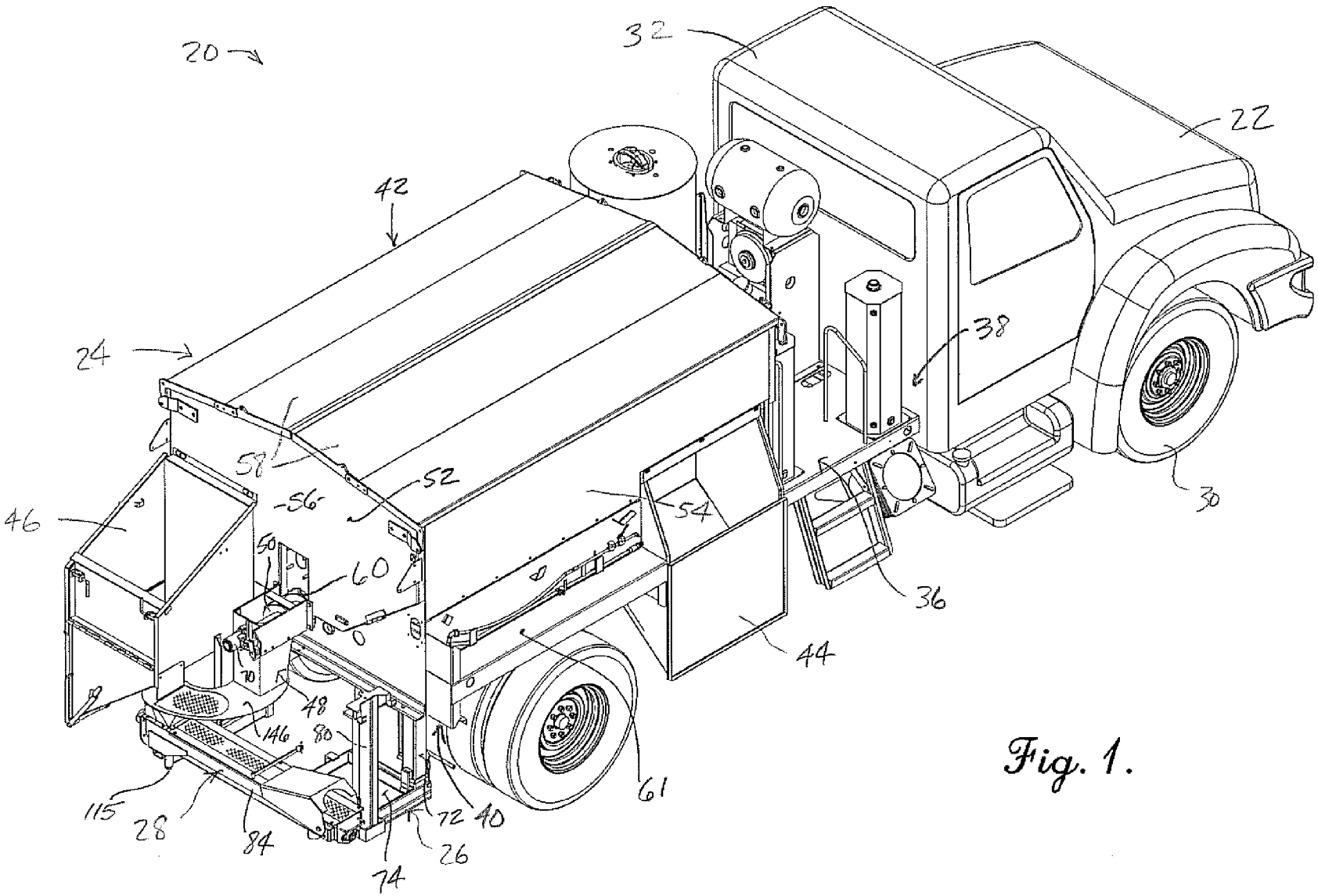
FIG. 1 is an upper rear perspective of an asphalt supply vehicle constructed in accordance with a preferred embodiment of the present invention.

Turning initially to FIG. 1, an asphalt supply vehicle 20 is used to transport asphalt mix to locations along a road to repair pavement failures, such as cracks, potholes, or buckled sections. Furthermore, the asphalt supply vehicle 20 is configured to accurately dispense the asphalt mix at each failure location. In the usual manner, the asphalt supply vehicle 20 is also operable to carry tools for making the repair. While the illustrated vehicle 20 is operable to carry and dispense asphalt, the principles of the present invention are applicable where the vehicle 20 is used to dispense other types of aggregate. Furthermore, the vehicle 20 could be used to dispense other types of granular or particulate materials. The asphalt supply vehicle 20 broadly includes a truck 22, an asphalt hopper assembly 24, an auxiliary platform 26, and an auger assembly 28.

Figure 3:
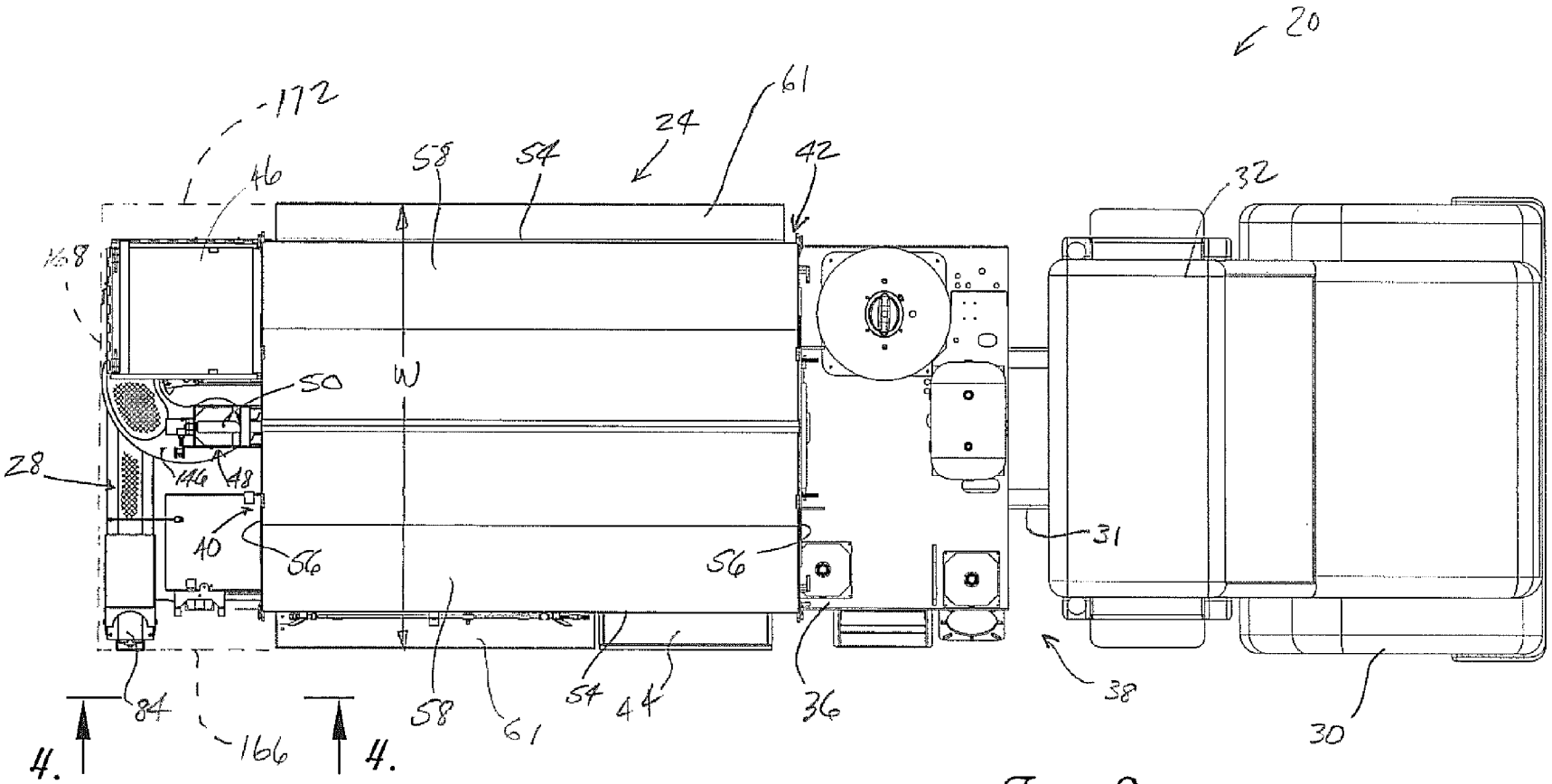
FIG. 3 is a plan view of the asphalt supply vehicle shown in FIGS. 1 and 2, showing the stored swing auger substantially spaced within outermost side and aft margins of the vehicle.
Figure 4:
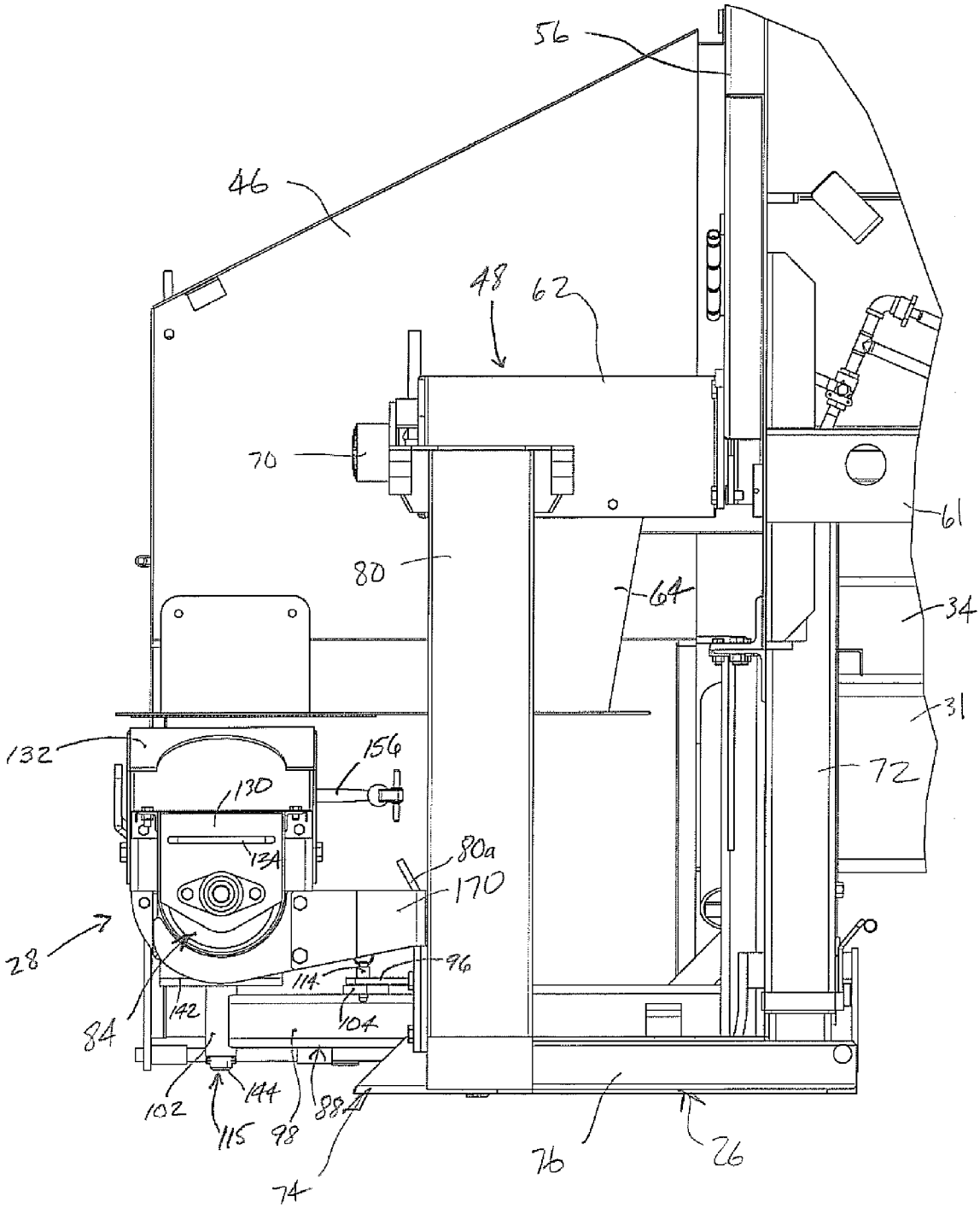
FIG. 4 is a right side elevation of the asphalt supply vehicle shown in FIGS. 1-3, showing an auxiliary platform of the vehicle in an uppermost transport position.
Figure 5:
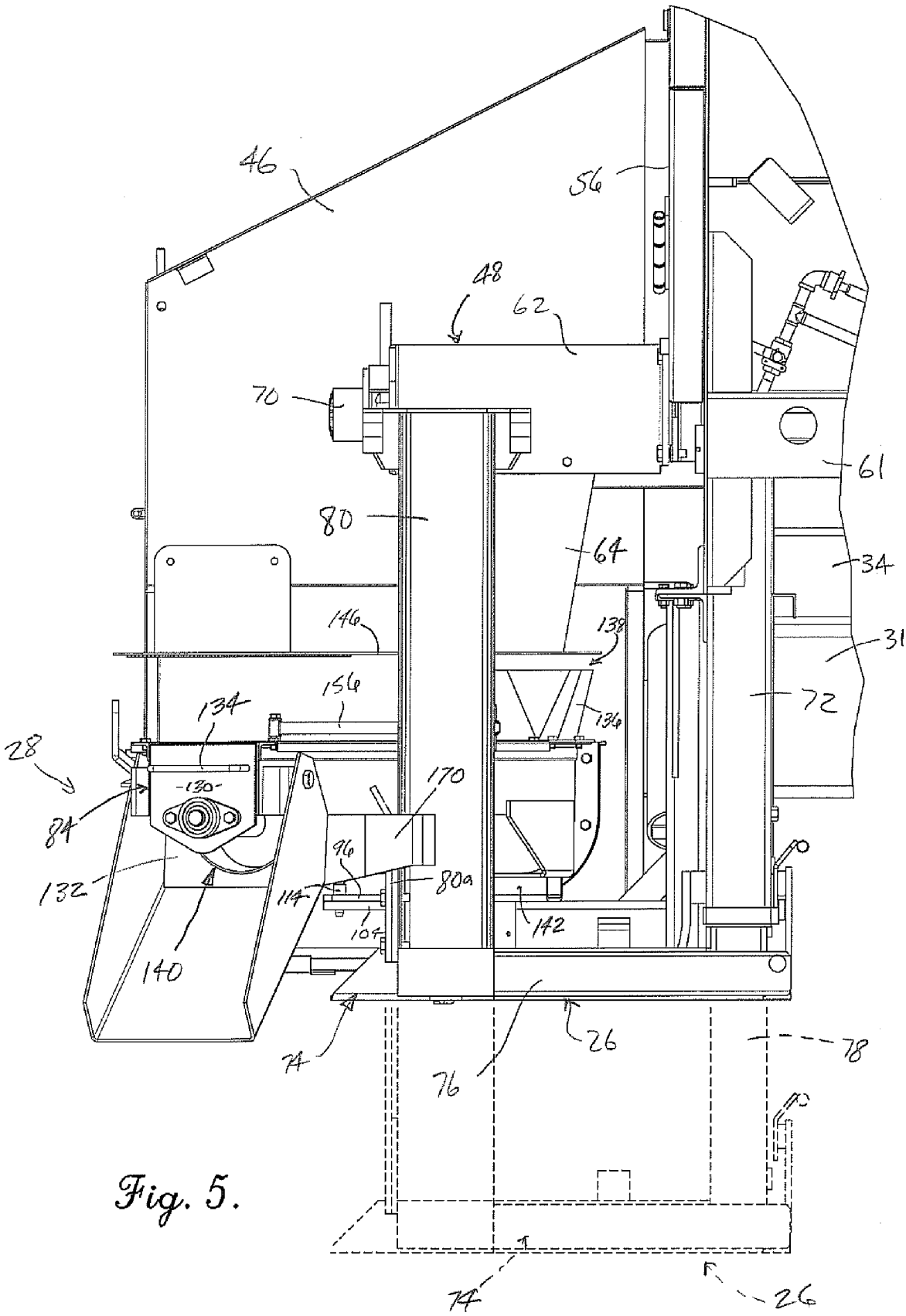
FIG. 5 is a right side elevation of the asphalt supply vehicle shown in FIGS. 1-4, showing the swing auger in an operating position and showing a lowermost position of the auxiliary platform in broken lines.

Turning to FIGS. 1-3, the truck 22 is a conventional vehicle and includes a rolling chassis 30 with chassis rails 31. The truck 22 further includes a cab 32 mounted adjacent a forward end of the chassis 30, and a tubular frame 34 mounted on the chassis rails 31 and positioned rearwardly of the cab 32. The illustrated frame 34 includes a pair of longitudinally extending tubes that each present a rectangular cross-sectional shape. Preferably, the tubes comprise steel rectangular tubing with a nominal cross section size of 3 inches by 6 inches, but it is within the scope of the present invention where the tubes have an alternative size or structural shape. The frame 34 also includes a forward platform 36 mounted adjacent a forward end of the tubes. The frame 34 also presents opposite fore-and-aft ends 38,40, and with the aft end 40 being spaced rearwardly of the rear wheels of the chassis 30. The frame 34 is supported on the truck 22 by mounting the tubes on corresponding rails 31. The truck 22 further includes an hydraulic motor driven generator (not shown) that is powered by the truck engine (not shown). The illustrated truck 22 is preferably a 35,000 GVW single-axle truck. However, it is also within the scope of the present invention where another type of wheeled vehicle is used to support the hopper and auger assemblies 24,28 and the platform 26, such as an alternative self-powered truck. Furthermore, the assemblies 24,28 and platform 26 could be supported on a trailer or another type of vehicle that is not self-powered.

Referring again to FIGS. 1-3, the asphalt hopper assembly 24 is operable to carry asphalt mix at a predetermined temperature, which is normally elevated above the ambient temperature, and supply the heated asphalt mix to the auger assembly 28, as will be discussed further. The asphalt hopper assembly 24 broadly includes a hopper bin 42, side and rear spoils bins 44,46, a spout 48, and a hopper auger 50. The hopper bin 42 is insulated and includes a container 52 with side walls 54 and opposite front and rear end walls 56 that form an internal chamber volume operable to receive the asphalt mix. The chamber volume of the container 52 is preferably between about 3 cubic yards and about 7 cubic yards. The side walls 54 cooperatively present a generally funnel-shaped cross section, with the width between the side walls 54 narrowing from the top to a lowermost trough (not shown). Thus, gravity causes asphalt held within the container volume to flow downwardly into the trough as asphalt is conveyed out of the hopper bin 42. The hopper bin 42 also includes a pair of hinged insulated doors 58 that cooperatively cover the open top of the container 52 and thereby enclose the chamber volume. The aft end wall 56 presents an auger opening 60 positioned adjacent a lower end of the aft end wall 56. The hopper bin 42 further includes right and left side fenders 61, attached to the container 52, with the hopper bin 42 presenting a width W of the hopper assembly 24 preferably between about 84 and 108 inches, and more preferably about 96 inches. The hopper bin 42 further includes electric heating elements (not shown) that are powered by the generator and are configured to heat the asphalt mix to the predetermined temperature. However, the hopper bin 42 could be heated using another mechanism, such as a propane heater. While the vehicle 20 preferably includes the illustrated hopper bin 42, the principles of the present invention are equally applicable where an alternatively constructed hopper is used to carry the asphalt mix.

Still referring to FIGS. 1-3, the hopper bin 42 is mounted on the frame 34 with the fenders 61 positioned laterally outwardly from the frame tubes, and with the rear end wall 56 positioned adjacent the aft end 40 of the frame 34. Thus, the frame 34 extends substantially the entire length of the hopper bin 42. The hopper bin 42 is spaced rearwardly of the forward platform 36, and the forward platform 36 is configured to receive auxiliary equipment such as a tack coat storage system. Also, the hopper bin 42 is positioned with a longitudinal hopper axis HA (FIG. 10) aligned with a longitudinal truck axis TA (FIG. 10) so that the hopper bin 42 is substantially centered in a lateral (i.e., side-to-side) direction relative to the frame 34. However, it is also within the scope of the present invention where the hopper bin 42 is alternatively positioned on the frame 34, e.g., where the hopper bin 42 is offset to either the right side or left side of the frame 34.

Turning again to FIGS. 1-3, the spoils bins 44,46 are used to carry broken chunks of pavement and other road debris and are conventional. The spoils bins 44,46 both include sides that form a bin chamber, an open top, and a lower angled chute. The bins 44,46 include a lower door that can be closed so that the chamber holds debris, or opened so that debris within the chamber can flow through the chute and out of the chamber. The side spoils bin 44 is mounted on the hopper bin 42 and spaced between the fore-and-aft ends 38,40 of the frame 34. The side spoils bin 44 is located adjacent right side of the hopper bin 42. The rear spoils bin 46 is mounted adjacent the aft end 40 and attached to the aft end wall 56 to extend rearwardly from the hopper bin 42. The rear spoils bin 46 is also positioned adjacent the left side of the hopper bin 42, with the left side and the lower door of the rear spoils bin 46 being aligned with the left side of the hopper bin 42. However, it is also within the ambit of the present invention where the spoils bins 44,46 are alternatively constructed or alternatively mounted relative to the hopper bin 42.

Turning to FIGS. 1, 4, 5, and 8-10, the spout 48 is generally L-shaped and includes an upper horizontal spout body 62 and a lower, vertical chute 64 attached along a bottom edge of the spout body 62. The spout 48 is attached to the aft end wall 56 so that an open end of the spout body 62 fluidly communicates with the opening 60 (see FIG. 1). Furthermore, the lower chute 64 is positioned directly below upper spout body 62. The lower chute 64 presents a discharge opening 66 (FIG. 8) spaced below the spout body 62. Spout 48 generally permits asphalt mix to flow into the spout body 62 and then drop in a downward direction through the lower chute 64 and then through the discharge opening 66. However, the spout 48 could be alternatively constructed and positioned without departing from the scope of the present invention. For instance, the lower chute 64 could be constructed to extend laterally away from the spout body 62 to locate the discharge opening 66 in a different position relative to the opening 60, e.g., to the right or left side of the opening 60.

The hopper auger 50 is operable to move asphalt from the hopper bin 42 into the spout 48. The hopper auger 50 includes a screw conveyor 68 and an hydraulic motor 70. The screw conveyor 68 is rotatably mounted, with an aft end mounted on the spout body 62 and a forward end mounted adjacent the forward end wall 56 of the hopper bin 42. The screw conveyor 68 is positioned in the trough of the hopper bin 42 and extends longitudinally along the trough and rearwardly through the opening 60 in the aft end wall 56. The hydraulic motor 70 is attached to the spout body 62 and is drivingly attached to the aft end of the screw conveyor 68. Thus, the hopper auger 50 is operable to be powered by the motor 70 to rotate the screw conveyor and thereby convey asphalt from the hopper bin 42 into the spout 48, with gravity causing the asphalt to fall through the lower chute 64 and through the discharge opening 66.

Turning to FIGS. 4, 5, and 9-11, the auxiliary platform 26 is configured to carry pavement repair tools (not shown) and includes an upright, fixed housing 72, a horizontal, vertically shiftable platform 74, and a hydraulic cylinder (not shown)

within housing 72 that moves the shiftable platform 74 vertically relative to the housing 72. The illustrated platform 26 is dimensioned and configured to carry pavement repair tools such as an hydraulic pavement breaker and a vibratory compactor. Exemplary compactors include a Single-drum Vibratory Roller, Model No. BW55E, manufactured by Bomag GmbH of Germany, and a Vibratory Asphalt Plate, Model No. VP1550AW, manufactured by Wacker Construction Equipment AG.

The housing 72 comprises an upright tube with an upper end mounted adjacent a rear, right side corner of the hopper bin 42 and extending downwardly therefrom. The platform 74 includes a deck 76, a telescopic square shaft 78 (FIG. 5) attached to and projecting upwardly from a front corner of the deck 76, and an upstanding, tool-carrying post 80 attached to and projecting upwardly from a rear corner of the deck 76. The platform 74 further includes a latching bracket 80*a* attached to a rear edge of the upright post 80, with the post 80 and bracket 80*a* cooperatively presenting a slot for receiving a retainer component of the auger assembly 28, as will be discussed. The shaft 78 is telescopically received by the housing 72 and drivingly attached to the internal cylinder so as to be shifted into and out of the housing 72 between upper and lower positions. Thus, the platform 26 is configured to carry repair tools in the upper position. In particular, the deck 76 is configured to support a compactor, while the post 80, via hooks attached to the upper end thereof is configured to support a pavement breaker. The platform 26 can also shift into the lower position (shown in phantom lines in FIG. 5) to load or unload tools from the platform 74.

Turning to FIGS. 6-11, the auger assembly 28 is operable to convey asphalt that drops out of the spout 48 to various locations spaced from the truck 22. The auger assembly 28 broadly includes a support linkage 82 and a swing auger 84. The linkage 82 is operable to shiftably support the swing auger 84, as will be discussed, and includes a fixed, generally U-shaped mounting bracket 86 and a swingable pivot arm 88. The mounting bracket 86 includes a pair of horizontally spaced apart upright members 90,92 and a fore-and-aft transverse member 94 that rigidly interconnects the upright members 90,92 adjacent their lower ends. The front upright member 90 is rigidly attached adjacent an aft end of the hopper bin 42, and rear upright member 92 is rigidly attached to the rear spoils bin 46. The mounting bracket 86 further includes a pair of vertically spaced lugs 96 fixed to and projecting rearwardly from a rear end of the fore-and-aft member 94.

The pivot arm 88 includes an elongated body 98 and a pair of proximal and distal, upright sleeves 100,102 fixed to opposite ends of the body 98. The illustrated pivot arm 88 presents a center-to-center distance between the sleeves 100,102 preferably greater than about four (4) inches, and more preferably about twelve (12) inches. The pivot arm 88 further includes an arcuate indexing bracket 104 attached to a top edge of the body 98. The proximal sleeve 100 is pivotally mounted to the hinge lugs 96 by a hinge pin 106 that passes through the sleeve 100 and through a pair of aligned holes in the hinge lugs 96. Thus, the hinge lugs 96, sleeve 100 and pin 106 cooperatively form a pivotal joint 107 that permits the arm 88 to pivot relative to the mounting bracket 86 about an upright swivel axis SA (see FIGS. 6 and 7).

The pivot arm 88 can be selectively locked into an auger storage location or an auger operating location. In particular, the indexing bracket 104 has indexing holes 108,110 adjacent its opposite ends that define a swivel angle $\alpha$ therebetween (FIG. 7). Swivel angle $\alpha$ is preferably about 125 degrees. By properly manipulating arm 88, the indexing holes 108,110 can each be selectively alternatively aligned with an arm locating hole 112 in an extension of upper hinge lug 96. Holes 108,110 correspond to respective storage and operating locations of the pivot arm 88. Thus, the pivot arm 88 can be secured in the storage location (FIGS. 6 and 9) by inserting a locking pin 114 through hole 108 in bracket 104 (see FIG. 7 for hole 108) and hole 112 in top lug 96. Alternatively, the pivot arm 88 can be secured in the operating location (FIGS. 7 and 8) by inserting the pin 114 through hole 110 (see FIGS. 6 and 8 for hole 110). With the pin 114 removed, the pivot arm 88 is generally free to swivel between the illustrated locations. However, it is also within the scope of the present invention where the pivot arm 88 swivels beyond the illustrated locations. Consequently, the holes 108,110 define the swivel angle $\alpha$ through which the pivot arm 88 swivels from the storage location to the operating location. However, the linkage 82 could be alternatively configured to provide a different angle between the storage and operating locations. While the illustrated linkage 82 is preferable for supporting the swing auger 84, other mechanisms could be used to mount the swing auger 84 without departing from the broad scope of the present invention.

As illustrated best in FIG. 8, swing auger 84 has a mounting bracket 142 attached to the underside thereof adjacent its inboard end. The mounting bracket 142 includes a downwardly extending stud 144 that is pivotally received by the distal sleeve 102 to form another pivotal joint 115 in linkage 82, such joint 115 being between the pivot arm 88 and the swing auger 84. Thus, the pivotal joint 115 permits relative pivotal movement between the pivot arm 88 and the swing auger 84 about an upright pivot axis PA (see FIGS. 6 and 7).

Turning to FIGS. 8-11, the swing auger 84 includes an auger housing 116, a screw conveyor 118 within housing 116, and a hydraulic motor 120 drivingly coupled with screw conveyor 118 at the inboard end thereof. The auger housing 116 includes a channel-shaped body that presents an elongated trough 124 (see FIGS. 8, 9, and 11) extending between proximal and distal ends of housing 116. The illustrated trough 124 presents a length of about sixty (60) inches. The auger housing 116 also includes an elongated top 126 that includes a mesh panel extending along the length thereof, with the top 126 being attached along a top edge of the trough 124 to enclose the same. Furthermore, the auger housing 116 includes proximal and distal end panels 128,130 attached to the proximal and distal ends of trough 124 and a discharge chute 132 pivotally attached to the distal end of trough 124. The chute 132 is pivotal about a generally horizontal axis between an unfolded position (see FIGS. 10 and 11) for discharging material from swing auger 84 and a folded position (see FIG. 9) for transport. An auger handle 134 is attached to an outer surface of the distal end panel 130. A funnel 136 projects upward from the top edge of auger housing 122 adjacent the proximal end and opens downwardly into trough 124. Thus, the funnel 136 presents an inlet 138 for swing auger 84 that fluidly communicates with the trough 124. The housing 116 also presents an auger outlet 140 adjacent the distal end that fluidly communicates with the trough 124. Pivot joint 115 and axis PA are axially aligned with auger inlet 138.

The screw conveyor 118 is rotatably mounted to the end panels 128,130 and extends through the trough 124. The illustrated screw conveyor 118 has a diameter preferably about six (6) inches, with an auger pitch of about nine (9) inches. The hydraulic motor 120 is mounted to the end panel 128 and is operable to rotate the screw conveyor 118. The motor 120 is configured to rotate the conveyor 118 at a speed of at least about 50 rpm and, more preferably, about 100 rpm. The motor 12 also preferably has a torque between about 8000 in-lbs and about 9500 in-lbs and, more preferably, about 8,674 in-lbs. The illustrated motor 120 preferably turns the screw conveyor 118 at a speed about 30 percent faster than the speed of the screw conveyor 68. Thus, swing auger 84 is able to convey asphalt mix at a faster rate than the hopper auger 50. The motor 120 is driven by an on-board hydraulic power supply (not shown). As asphalt is dropped through the funnel 136 and enters the trough 124, the screw conveyor 118 conveys the asphalt from the proximal end to the distal end, where the asphalt is discharged through the outlet 140 and directed by the chute 132 to a location where pavement is being repaired.

The linkage 82 is operable to permit manual shifting of the swing auger 84 between auger storage and operating positions. In particular, pivot 115 (and the pivot axis PA) moves along an arcuate path P about the pivot 107 and swivel axis SA (see FIGS. 6 and 7) when arm 88 is swung about pivot 107. The inlet 138, which is centered relative to the pivot axis PA, also follows pivot 115 along the path P. Thus, as pivot arm 88 is swung from storage location to operating location, the inlet 138 shifts from location $PA_1$ to location $PA_2$ (FIG. 6). Preferably, as the pivot arm 88 carries the auger 84 back from the operating position of FIG. 7 to the storage position of FIG. 6, the inlet 138 and auger 84 are shifted laterally toward the left side of the vehicle (as viewed from the rear looking forwardly) to provide compact auger storage as will be discussed.

A flat, generally C-shaped, fixed, horizontally extending cover panel 146 overlies funnel 136 at the inboard end of swing auger 84. Cover panel 146 is mounted at one end thereof to rear spoils bin 46 and has a pair of openings 150, 152 adjacent its opposite ends. A mesh grate 154 spans the opening 152. The cover panel 146 is positioned so that the opening 150 receives the lower end of the spout 48. Furthermore, the cover panel 146 is shaped and positioned to remain in a generally covering relationship to the funnel 136 as the pivot arm 88 guides the swing auger 84 along the path P between its storage and operating positions. In this manner, the cover panel 146 restricts foreign objects from falling into the funnel 136 and being ingested by the swing auger 84. However, the grate 154 permits cleaning fluid to be sprayed into the inlet 138 when the swing auger 84 is in the storage position.

When the pivot arm 88 is in the storage location of FIGS. 1-4, 5, 6 and 9, the proximal end of the swing auger 84 is disposed in the auger storage position where the inlet 138 thereof is spaced laterally and rearwardly from the discharge opening 66 of chute 64 and positioned directly underneath the opening 152 and grate 154. Preferably, when swing auger 84 is in its storage position, the inlet 138 is laterally offset from chute 64 by a distance at least about the diameter of the inlet 138 to provide compact auger storage and so that the inlet 138 is not positioned to receive asphalt mix from the discharge opening 66. More preferably, when shifted from the operating position to the storage position, the inlet 138 is shifted in a lateral direction toward the left side of the vehicle (and away from the discharge opening 66) a distance between about 6 inches and about 24 inches.

When the pivot arm 88 is in the operating location of FIGS. 5, 7, 8, 10, and 11, the proximal end of the swing auger 84 is disposed in the auger operating position where the inlet 138 is spaced directly below the opening 150 and the discharge opening 66 so that the spout 48 and funnel 136 fluidly communicate with one another and permit asphalt to flow from the spout 48 and into the trough 124.

As illustrated in FIG. 10, when swing auger 84 is in the operating position it can be manually swung about pivot 115 through a total pivot angle $\beta_1+\beta_2$ of about 110° from an outermost right side orientation (solid lines) to a generally outermost left side orientation and operated in an infinite number of positions between those two extremes. However, it is also within the scope of the present invention where the swing auger 84 can be swung through an alternative pivot angle $\beta_1+\beta_2$. For instance, the auxiliary platform 26 could be removed from the vehicle 20 so that the swing auger 84 can pivot through a pivot angle of about 130°. Alternatively, the auxiliary platform 26 and rear spoils bin 46 could both be removed from the vehicle 20 so that the swing auger 84 can pivot through a pivot angle of about 180°. In the left side orientation, the outlet 140 of the swing auger 84 is positioned rearwardly of the rear spoils bin 46 and is longitudinally aligned with the left side wheels of the chassis 30. In the right side orientation, the outlet 140 is spaced rearwardly from the truck 22 and laterally outside of the right side wheels of the chassis 30 in a direction transverse to the longitudinal truck axis. In an exemplary intermediate rearward orientation, the outlet 140 is aligned with the hopper axis HA.

An elastic strap 156 may be used to hold swing auger 84 in the right side orientation. As shown in FIGS. 9 and 10, strap 156 has a cylindrical eyelet 158 at one end and a spherical head 160 and handle 162 at its opposite end. The shank 158 is attached to the auger housing 116 with a threaded fastener. The free end of the strap 156 may be selectively attached to a yoke-shaped bracket 164 on post 80 of the platform 74 by pulling the handle 162 to stretch the strap 156 through the notch in bracket 164 and then positioning the head 160 on the far side thereof.

In the storage position of FIGS. 1-4, 5, 6, and 9, the auger inlet 138 is offset laterally in a rearward direction from the operating position and is spaced underneath grate 154. In this position swing auger 84 extends in a direction generally parallel to an aft margin 168 of the vehicle as shown in FIG. 3. The swing auger 84 is operable to be held in this orientation by the platform 74. In particular, with reference to FIGS. 4, 5, 9 and 10, the swing auger 84 includes a generally angle-shaped lug 170 attached to the distal end of auger trough 124. The bracket 80*a* of platform 74 slidably receives and holds the lug 170 and thereby serves as a latch to lock the swing auger 84 in the storage orientation.

The lug 170 is latched by first shifting the platform 74 into the lower platform position. The platform 74 is then raised into the upper platform position while swing auger 84 is in the storage position, and the bracket 80*a* and upright 80 consequently move upwardly into capturing engagement with the lug 170. Thus, the illustrated latch mechanism and the linkage 82 cooperatively hold the swing auger 84 for transport in the storage position. However, it is also within the scope of the present invention to have the swing auger 84 held in the storage orientation with a different latching mechanism.

When in the storage position of FIGS. 1-4, 5, 6 and 9, the swing auger 84 is compactly positioned relative to the truck 22. In particular, with reference to FIG. 3, the illustrated asphalt supply vehicle presents an outermost vehicle right side margin 166, an outermost vehicle left side margin 172, and the rearmost vehicle aft margin 168. The stored swing auger 84 preferably is so sized and positioned that in the storage orientation it is entirely disposed within the vehicle margins 166, 168, and 172. Preferably when moved from the operating position to the storage position, the swing auger 84 is shifted laterally toward the left side of the vehicle 20 to accommodate the length of the swing auger 84. In this manner, the swing auger 84 is compactly positioned relative to the remainder of the vehicle 20 and does not project outwardly from the vehicle 20 to the side or to the rear during transport.

However, the swing auger 84 could be alternatively sized and configured to achieve this compact storage position. For example, the swing auger 84 could be arranged in a position non-parallel with the vehicle aft margin 168. Also, the swing auger 84 could extend at least partly in a generally upright direction when in the storage position. Additionally, the swing auger 84 could be arranged in a compact storage position while extending outside of the margins 166, 168, 172 without departing from certain aspects of the present invention.

The swing auger 84 also presents a length from the pivot axis PA to the end of the chute 132 preferably greater than about half the width W of the hopper assembly 24, and most preferably greater than about 60 inches. In this manner, the swing auger 84 is able to extend preferably beyond the outermost vehicle right side margin 166 in the operating position (see FIG. 10). In the right side orientation, the swing auger 84 extends beyond the outermost vehicle right side margin 166 about at least fifteen inches. In the rearward projecting orientation, the swing auger 84 extends beyond the outermost vehicle aft margin 168 about at least forty inches. Furthermore, swing auger 84 is spaced from the ground (not shown) preferably about twenty-four inches. In this manner, the swing auger 84 is operable to accurately dispense asphalt in a wide variety of locations along a road, such as the middle of the road, a shoulder, or a curb-and-gutter. The swing auger 84 can be held in the right side orientation by the secured strap 156, e.g., to control the swing auger 84 while filling asphalt along a shoulder or curb-and-gutter as the truck 22 drives along the road.

In operation, the vehicle 20 is operable to carry asphalt mix to locations where pavement failures have occurred. The vehicle 20 is operable to travel to the locations with the swing auger 84 locked in the storage position. The swing auger 84 is prepared to dispense asphalt by first being unlocked from the storage position, i.e., by lowering the platform 74 to release the lug 170 and then releasing the pin 114 from the upper lug 96 and hole 108 in bracket 104. The swing auger 84 can then be swiveled about double pivots 107,115 from the storage position to the operating position, and the pin 114 can then be reinserted in upper lug 96 and hole 110 of bracket 104 to hold the swing auger 84 in the operating position. Asphalt is then augered from the hopper bin 42 by rotating the screw conveyor 68 of the hopper auger 50, and asphalt discharged from the hopper bin 42 drops through the spout 48 and into the auger inlet 138. At the same time, the screw conveyor 118 of swing auger 84 is rotated to convey asphalt from the inlet 138 to the outlet 140 and then through the chute 132. The swing auger 84 can be pivoted about pivot 115 as desired to dispense asphalt from one side of the vehicle 20 to the other and beyond the right side of the vehicle 20. The swing auger 84 can then be swiveled back to the storage position about double pivots 107,115 and pinned so that the vehicle 20 can drive to another location to repair a pavement failure.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A material dispensing vehicle comprising:

a wheeled vehicle;

a material hopper supported by the vehicle and presenting a discharge opening; and an elongated swing auger presenting an inlet and an outlet adjacent opposite ends thereof, said swing auger being operably coupled to the vehicle in an operating position wherein the inlet is disposed to receive material from the discharge opening and the outlet projects outward beyond at least one of the vehicle and hopper to dispense the augered material, said swing auger being selectively retractable out of the operating position and into a storage position where the inlet is laterally spaced from the discharge opening and the outlet is disposed inboard from a position of the outlet when the swing auger is in the operating position.

2. The material dispensing vehicle as claimed in claim 1, said material dispensing vehicle presenting laterally outermost vehicle side margins and a rearmost vehicle aft margin, said outlet of the swing auger being disposed when in the operating position to project outward beyond at least one of the margins to dispense the augered material, said swing auger being at least substantially entirely located within the margins when in the storage position.

3. The material dispensing vehicle as claimed in claim 1; and a latch element for releasably retaining the swing auger in the storage position.

4. The material dispensing vehicle as claimed in claim 3, said latch element comprising a vertically shiftable platform configured to store a material-working tool, said platform being adapted to retain the swing auger when the platform is in a raised position and to release the swing auger when the platform is in a lowered position.

5. The material dispensing vehicle as claimed in claim 1, said vehicle comprising a self-powered vehicle.

6. A material dispensing vehicle comprising:

a wheeled vehicle;

a material hopper supported by the vehicle and presenting a discharge opening; and an elongated swing auger presenting an inlet and an outlet adjacent opposite ends thereof, said swing auger being operably coupled to the vehicle in an operating position wherein the inlet is disposed to receive material from the discharge opening and the outlet projects outward beyond at least one of the vehicle and hopper to dispense the augered material, said swing auger being selectively retractable out of the operating position and into a storage position where the inlet is spaced from the discharge opening and the outlet is disposed inboard from a position of the outlet when the swing auger is in the operating position, said swing auger being pivotally mounted at a first pivot joint to permit generally horizontal swinging movement of the swing auger while in the operating position, said pivot joint being laterally shiftable to permit movement of the swing auger between the operating and storage positions.

7. The material dispensing vehicle as claimed in claim 6, said inlet being located below the discharge opening in the operating position to permit gravity flow of material from the opening into the auger.

8. The material dispensing vehicle as claimed in claim 7, said inlet being laterally spaced from the discharge opening in the storage position.

9. The material dispensing vehicle as claimed in claim 6; and a linkage supported by the vehicle and pivotally connected to the swing auger at said first pivot joint to permit shiftable auger movement between the positions.

10. The material dispensing vehicle as claimed in claim 9, said linkage including a pivot arm that supports the swing auger at said first pivot joint and is pivotally attached to the vehicle at a second pivot joint, with the arm operable to swing about the second pivot joint as the swing auger is shifted between the operating and storage positions.

11. The material dispensing vehicle as claimed in claim 10, said pivot arm presenting opposite ends, with one end pivotally attached to the vehicle at said second pivot joint and the other end pivotally attached to the swing auger at said first pivot joint.

12. The material dispensing vehicle as claimed in claim 11, said linkage including a bracket fixed to the vehicle, with the bracket and pivot arm being pivotally interconnected at said second pivot joint, said linkage including a releasable fastener that is operable to latch the pivot arm to the bracket in either selected one of the storage and operating positions to retain the pivot arm against movement.

13. The material dispensing vehicle as claimed in claim 11, said pivot arm being operable to swing through an included angle of about 125 degrees.

14. The material dispensing vehicle as claimed in claim 11, said swing auger being swingable through an included angle relative to the pivot arm of about 110 degrees.

15. The material dispensing vehicle as claimed in claim 6, said swing auger including an auger housing and a strap attached to the housing, said strap being releasably attachable to the vehicle to restrict swinging movement of the swing auger while in the operating position.

16. The material dispensing vehicle as claimed in claim 1, said hopper including a hopper bin and a downwardly pointing spout attached to the bin, with the spout presenting the discharge opening.

17. The material dispensing vehicle as claimed in claim 16, said hopper including a hopper auger extending from the hopper bin into the spout.

18. The material dispensing vehicle as claimed in claim 16, said hopper bin presenting a lateral width, said discharge opening being laterally centered relative to the hopper bin width.

19. The material dispensing vehicle as claimed in claim 6, said inlet being positioned beneath the discharge opening in the operating position and being spaced laterally from the discharge opening in the storage position.

20. A material dispensing vehicle comprising:

a mobile chassis;

a material hopper carried by the chassis and having a material discharge opening through which materials may be discharged downwardly out of the hopper;

an elongated auger having a material inlet at one end and a material outlet at the opposite end; and a support mounting said auger on the chassis in an operating position wherein the inlet is disposed below the discharge opening of the hopper for receiving material therefrom and conveying the received material to the outlet, said support having a first pivotal connection with the auger permitting the auger to pivot generally horizontally about a first upright axis while in the operating position for dispensing materials from any selected one of a number of angularly adjusted locations, said support further having a second pivotal connection with said chassis permitting the support to swing generally horizontally about a second upright axis to shift the auger out of the operating position and into a storage position in which the inlet of the auger is spaced laterally from the discharge opening of the hopper.

* * * * *